United States Patent [19]

Pourchot

[11] 4,343,518

[45] Aug. 10, 1982

[54] ROD GUIDE APPARATUS

[75] Inventor: Melvin E. Pourchot, Shawnee, Okla.

[73] Assignee: Central Plastics Company, Shawnee, Okla.

[21] Appl. No.: 191,086

[22] Filed: Sep. 26, 1980

[51] Int. Cl.[3] ..... F16C 29/02

[52] U.S. Cl. ..... 308/4 A; 166/176; 166/241

[58] Field of Search ..... 308/4 R, 4 A; 166/175, 166/176, 241

[56] References Cited

U.S. PATENT DOCUMENTS

| | | | |
|---|---|---|---|
| 3,197,262 | 7/1965 | Fairchild | 308/4 A |
| 3,292,708 | 12/1966 | Mundt | 308/4 A X |
| 3,399,730 | 9/1968 | Pourchot | 308/4 A X |

*Primary Examiner*—Stuart S. Levy
*Assistant Examiner*—Daniel P. Stodola
*Attorney, Agent, or Firm*—Laney, Dougherty, Hessin & Beavers

[57] ABSTRACT

A rod guide apparatus for a reciprocating rod comprised of two substantially identical half sections which include semicircular recesses therein and which are adapted to be lockingly clamped together adjacent opposite sides of the outer periphery of the rod whereby the rod extends through a bore formed by the semicircular recesses in the half sections. By the present invention each of the half sections includes at least one longitudinally extending ridge on a surface thereof within said semicircular recess whereby when the half sections are clamped together adjacent opposite sides of the rod, the ridges are positioned on opposite sides of the rod and deform the bore formed by the recesses through which the rod passes into a cross section of elliptical shape so that the clamped together half sections contact the periphery of the rod at at least four points thereby preventing slippage of apparatus on the rod.

5 Claims, 7 Drawing Figures

ROD GUIDE APPARATUS

BACKGROUND OF THE INVENTION

1. Field of the Invention

The present invention relates generally to improved rod guide apparatus, and more particularly, but not by way of limitation, to an improved rod guide apparatus formed of plastic material for reciprocating rods such as sucker rods in oil wells.

2. Description of the Prior Art

A variety of rod guides, paraffin scrapers and the like have been developed and used for protecting rods which are reciprocated within a conduit. For example, sucker rods in pumping oil wells normally extend longitudinally through tubing diposed in the well bore and are reciprocated therein during pumping of the well. In order to prevent the sucker rods from engaging the walls of the tubing during the reciprocation thereof and the consequent wear on the rods, rod guides attached to the rods at intervals have been utilized. In oil wells which produce heavy hydrocarbons such as paraffin which deposit on the sides of the tubing, scrapers which also functions as rod guides have been used.

A particularly suitable rod guide and paraffin scraper is described in U.S. Pat. No. 3,399,730 dated Sept. 3, 1968. Such rod guide or paraffin scraper is formed of a plastic material which insulates a metal rod from electrolytic action and the consequent corrosion damage. The rod guide or paraffin scraper is comprised of two substantially identical half sections which include semicircular recesses therein and which are adapted to be lockingly clamped together against opposite sides of the outer periphery of the rod whereby the rod extends through a circular bore formed by the semicircular recesses in the half sections. In use of the rod guides or paraffin scrapers, they are attached to the rod at intervals along the length thereof thereby preventing the rod from contacting the tubing or conduit within which it is reciprocated.

While the rod guide or paraffin scraper described in U.S. Pat. No. 3,399,730 includes a plurality of longitudinal rib members positioned on the surfaces of the semicircular recesses in the half sections which bite into or cut through any corrosion or coating which is present on the outer periphery of the rod when the apparatus is installed thereon, problems have been encountered as a result of the guide apparatus slipping longitudinally on the rod. Such slippage is primarily due to the fact that the outside diameter of sucker rod and the like is not uniform, and if the outer periphery of the rod is of a smaller diameter or a diameter equal to the inner periphery of the bore in the guide apparatus at the outer edges of the ridges therein, a tight fit between the outer periphery of the rod and the guide apparatus is not achieved. In addition, even where a tight fit between the apparatus and the rod is achieved upon installation of the apparatus, the force exerted on the guide apparatus as the rod is reciprocated due to the guide apparatus scraping the walls of a conduit within which it is disposed causes the guide apparatus to be enlarged whereby the rod can contact the tubing and cause damage thereto.

By the present invention an improved rod guide and/or paraffin scraper apparatus is provided which, when clamped on a rod, resists lateral slippage even when high lateral forces are exerted on the apparatus. Further, the improved rod guide apparatus of the present invention can be clamped on rods having variations in outside diameter and still resist longitudinal slippage.

SUMMARY OF THE INVENTION

An improved rod guide or scraper apparatus formed of a plastic material for a reciprocating rod comprised of two substantially identical half sections which include semicircular recesses therein adapted to be lockingly clamped together adjacent opposite sides of the outer periphery of the rod whereby the rod extends through a bore formed by the semicircular recesses in the half sections. Each of the half sections includes at least one longitudinally extending ridge on a surface thereof within the semicircular recess therein whereby when the half sections are clamped together adjacent opposite sides of the rod, the ridges are positioned on opposite sides of the rod and deform the bore formed by the semicircular recesses through which the rod passes into a cross section of elliptical shape so that the clamped together half sections forceably contact the rod at at least four points around the periphery thereof.

It is, therefore, an object of this invention to provide an improved rod guide apparatus.

A further object of the present invention is the provision of a rod guide or scraper apparatus formed of a plastic material which resists longitudinal slippage on a rod after installation thereon even when high longitudinal forces are exerted on the apparatus.

Yet a further object of the present invention is the provision of a rod guide or scraper apparatus formed of a plastic material which when clamped on rods having variations in outside diameter still resists longitudinal slippage.

Other and further objects, features and advantages of the present invention will be readily apparent to those skilled in the art upon a reading of the description of preferred embodiments which follows when taken in conjunction with the accompanying drawings.

BRIEF DESCRIPTION OF THE DRAWINGS

FIG. 6 is a sectional view taken along line 6—6 of FIG. 5.

DESCRIPTION OF PREFERRED EMBODIMENTS

Figure 1:
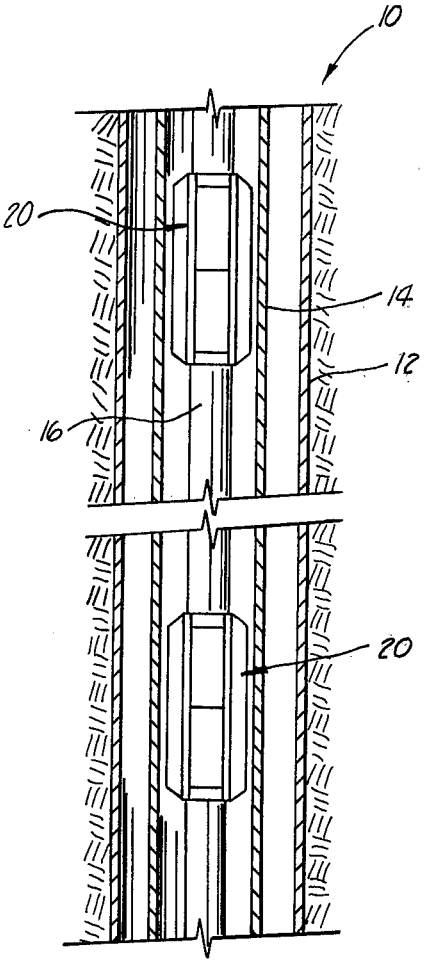
FIG. 1 is an elevational cross-sectional view of a portion of a well bore having sucker rod with the apparatus of the present invention attached thereto disposed therein.

Referring now to the drawings and particularly to FIGS. 1 through 6, a portion of a typical well bore having a string of sucker rod disposed therein is illustrated and generally designated by the numeral 10. The well bore 10 conventionally includes casing 12 adjacent the walls of the well bore 10 and a string of tubing 14 extending from a subterranean oil producing formation penetrated by the well bore to the surface. A string of sucker rod 16 is disposed within the tubing 14 which is reciprocated by a pumping unit and which operates pumping apparatus at the lower end of the tubing string 14 thereby causing oil to be pumped through the tubing string to the surface. Rod guide apparatus of the present invention, generally designated by the numeral 20, are attached to the rod 16 at intervals therealong to prevent the rod 16 from coming into contact with the tubing string 14 and thereby prevent wear and corrosion damage to the rod 16.

Figure 2:
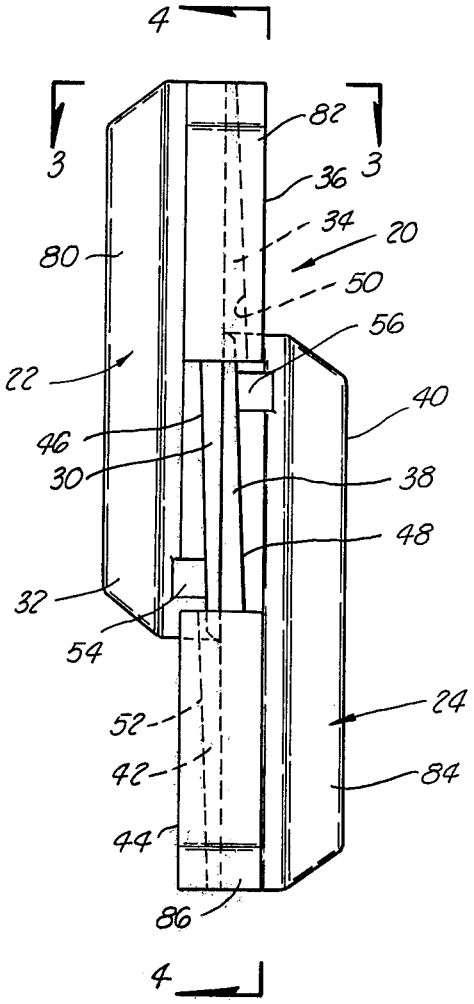
FIG. 2 is a side elevational view of the rod guide apparatus of the present invention.
Figure 3:
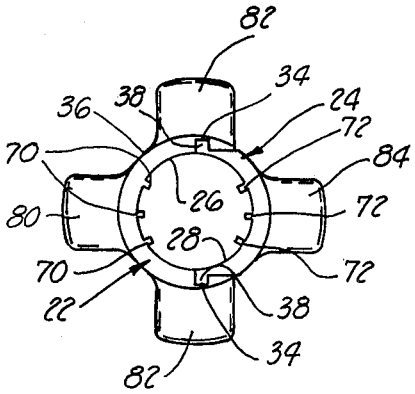
FIG. 3 is a view taken along line 3—3 of FIG. 2.
Figure 5:
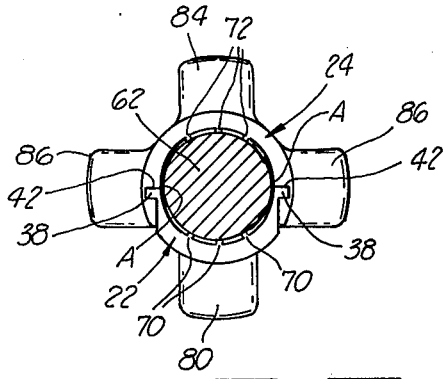
FIG. 5 is a side elevational view of the apparatus of the present invention attached to a rod.

Referring now to FIGS. 2 and 3, the rod guide apparatus 20 of the present invention is illustrated. The apparatus 20 is comprised of two substantially identical half sections 22 and 24 which include semicircular recesses 26 and 28 therein (FIG. 3) and which are adapted to be lockingly clamped together adjacent opposite sides of the outer periphery of a rod. The sections 22 and 24 each include longitudinal tongue and groove means for telescoping engagement with each other and for clamping the half sections 22 and 24 together adjacent opposite sides of a rod. Locking means are also provided for preventing disengagement of the tongue and groove means. In FIG. 2 the half sections 22 and 24 are shown positioned adjacent each other with the tongue and groove means thereof partially engaged whereby when the sections are moved vertically with respect to each other such that the ends thereof are in alignment, the tongue and groove means and locking means thereof are engaged and the sections 22 and 24 are clamped onto a rod as shown in FIG. 5.

The longitudinal tongue and groove means of the sections 22 and 24 are comprised of a pair of outwardly extending longitudinal flanges disposed in one end portion of each of the half sections and a pair of longitudinally opposing grooves disposed at the other end portion of each of the half sections. More specifically, the half section 22 includes a pair of outwardly extending longitudinal flanges 30 at the lower end portion 32 thereof and a pair of longitudinal opposing grooves 34 at the upper end portion 36 thereof. The half section 24 is identical to the half section 22 but is reversed in position and includes a pair of outwardly extending longitudinal flanges 38 at its upper end portion 40 and a pair of longitudinal opposing grooves 42 at the lower end portion 44 thereof. As is best shown in FIG. 3, the outwardly extending longitudinal flanges 38 of the half section 24 engage the longitudinal opposing grooves 34 of the half section 23, and in a like manner, the longitudinal flanges 30 of the half section 22 engage the grooves 42 of the half section 24. In addition, the outwardly extending longitudinal flanges 30 and 38 of the half sections 22 and 24 are provided with tapered surfaces 46 and 48 and the grooves 34 and 42 of the sections 22 and 24 include complementary tapered surfaces 50 and 52 so that when the half sections 22 and 24 are moved together vertically the flanges 30 and 38 are wedged in the grooves 42 and 34, respectively.

In order to prevent lateral movement between the half sections 22 and 24 when clamped together on a rod, locking means are provided to prevent relative longitudinal movement of the half sections. That is, each of the half sections 22 and 24 includes a pair of oppositely facing transverse grooves positioned at one end thereof and complementary inwardly facing protrusions for lockingly coacting with the grooves at the other end thereof. More specifically and referring to FIGS. 4 and 5, the half section 22 includes a pair of oppositely facing transverse grooves 54 disposed in the lower end portion 32 thereof and the half section 24 includes like grooves 56 disposed in the upper end portion 40 thereof. The half section 22 includes inwardly oppositely facing protrusions 58 at the upper end portion 36 thereof positioned to coact with the grooves 56 of the half section 24 when the sections 22 and 24 are clamped together, i.e., the protrusions 58 snap into the grooves 56 thereby locking the sections 22 and 24 together and preventing lateral movement therebetween. In the like manner, the half section 24 includes oppositely inwardly facing protrusions 60 in the lower end 44 thereof which coact with the grooves 54 in the half section 22. Thus, when the half sections 22 and 24 are clamped over the rod 16, as illustrated in FIG. 5, the tongue and groove means thereof, i.e., the flanges 30 and 38 and grooves 34 and 42 thereof, respectively, rigidly hold the half sections 22 and 24 together and clamp the inside surfaces of the recesses 26 and 28 against the outer periphery of the rod 16. The locking means, i.e., the grooves 54 and 56 and protrusions 58 and 60 thereof lock the half sections whereby they are prevented from moving laterally with respect to each other.

Figure 4:
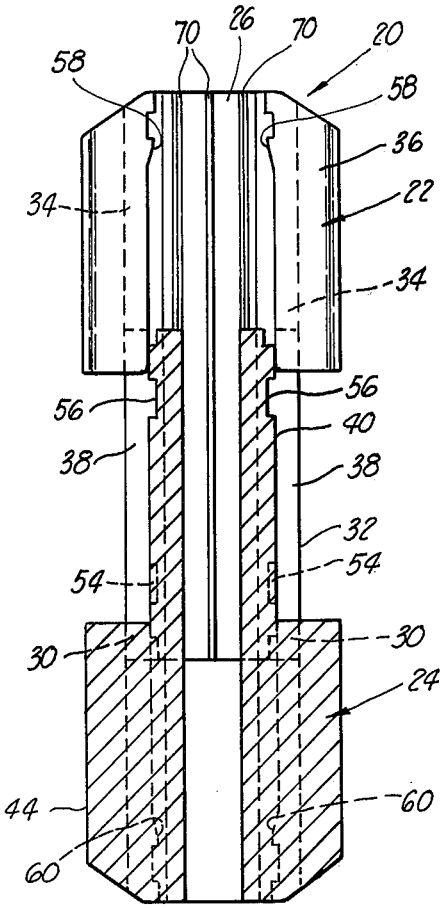
FIG. 4 is a sectional view taken along line 4—4 of FIG. 2.
Figure 3:
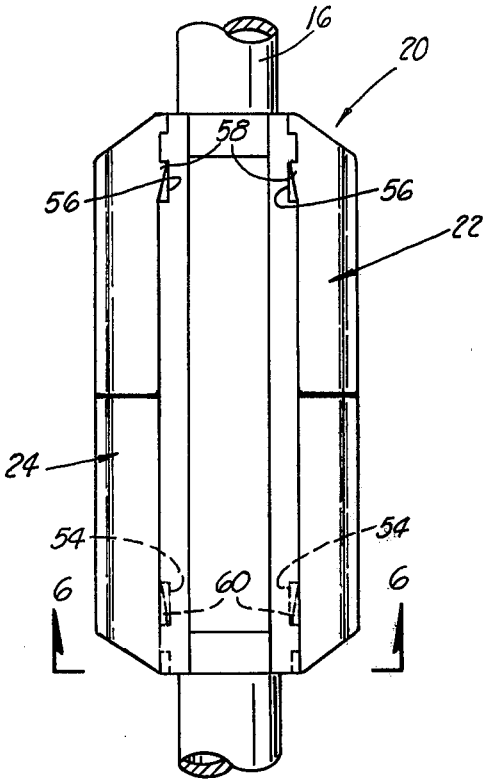

As shown in FIGS. 3 and 4, the half sections 22 and 24 include lateral ridges on the surface of the recesses 26 and 28 thereof. More specifically, the half section 22 includes three longitudinal ridges 70, one of which is positioned at the center of the semicircular recess 26 when the recess is viewed laterally from the open side thereof with the other two ridges 70 positioned on either side thereof equal short distances from the center ridge 70. In a like manner, the half section 24 includes three ridges 72 positioned within the semicircular recess 28 thereof so that when the half sections 22 and 24 are clamped together on a rod, the ridges 70 and 72 are adjacent opposite sides thereof. As shown in FIG. 6, the ridges 70 and 72 have a width and height such that when the half sections 22 and 24 are clamped on the rod 16, the ridges 70 and 72 are in contact with opposite sides of the rod 16 and cause the half sections 22 and 24 to deform whereby the bore through which the rod 16 passes formed by the semicircular recesses 26 and 28 in the half sections 22 and 24 takes on an elliptical shape in cross section. The deformation of the half sections 22 and 24 causes the clamped together half sections 22 and 24 to contact the outside periphery of the rod 16 at the surfaces of the ridges 70 and 72 and at opposite surfaces of the recesses which do not include ridges, i.e., at points designated in FIG. 6 by the letter A. The widths and heights of the ridges 70 and 72 are such that when the half sections 22 and 24 are clamped on the rod 16, the ridges 70 and 72 crush down to some extent which allows the half sections 22 and 24 to be clamped onto the rod 16 and resist slippage even if the rod 16 is of varying outside diameter.

Thus, the presence of the ridges 70 and 72 causes the deformation of the half sections 22 and 24 whereby the inside surfaces of the recesses 26 and 28 and the ridges 70 and 72 therein contact the rod 16 at at least four points, i.e., the surfaces of the ridges 70, the surfaces of the ridges 72 and the opposite surfaces designated by the letter A in FIG. 6. This four-point contact between the guide apparatus 20 and the rod 16 prevents the apparatus 20 from slipping laterally on the rod 16.

While the particular number of ridges 70 and 72 utilized in the apparatus 20 can vary, three ridges are preferably disposed on each of the half sections whereby the ridges contact the rod 16 on opposite sides over arcs of about 60°–70°. Each of the ridges 70 and 72 preferably has a width of from about 1/32 inch to about 1/16 inch and a height of from about 1/32 inch to about 3/32 inch. This width and height allows the ridges 70 and 72 to crush down to the extent required and allows the half sections to be utilized on a rod having varying outside diameter without affecting the lateral holding ability of the apparatus 20.

Each of the half sections 22 and 24 includes circumferentially spaced longitudinally extending enlarged guide ribs which provide contact surfaces for maintaining the rod 16 in a central position within the tubing string 14. More specifically, the half section 22 includes a longitudinal rib 80 extending the length thereof and a pair of opposite longitudinal ribs 82 extending half the vertical length of the half section 22. In a like manner the half section 24 includes a longitudinal rib 84 extending the length of the half section and opposite ribs 86 which are equally spaced from the rib 84 extending half the length of the section. As will be understood, the ribs 82 and 86 of the sections 22 and 24, respectively, align with each other when the sections 22 and 24 are clamped together so that four continuous circumferentially spaced longitudinal ribs are provided on the apparatus 20 having an effective outside diameter slightly less than the inside diameter of the tubing 14. As will be further understood, more or less than four outwardly extending guide ribs can be utilized on the apparatus 20 so long as sufficient space is left between the ribs for the passage of produced fluids within the tubing string 14 over the apparatus 20.

Figure 7:
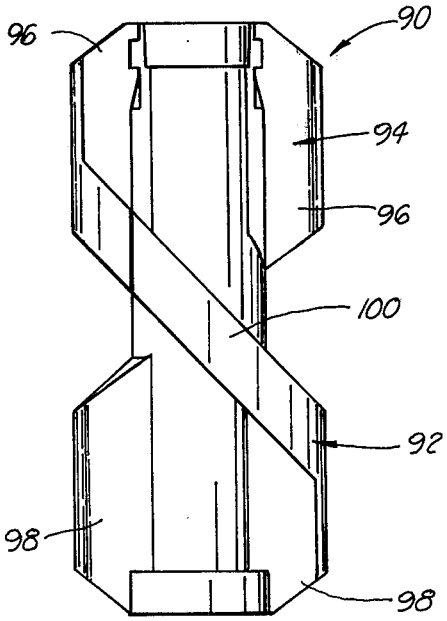
FIG. 7 is a side elevational view of an alternate form of apparatus of the present invention.

Referring now to FIG. 7, an alternate embodiment of the apparatus of the present invention generally designated by the numeral 90 is illustrated. The apparatus 90 is identical to the apparatus 20 previously described except that the outwardly extending guide ribs thereof are formed in a helical configuration whereby the apparatus functions as a scraper as well as a guide. More specifically, the apparatus 90 includes a pair of locked together half sections 92 and 94 which are identical to the half sections 22 and 24 except that instead of including outwardly extenging longitudinal ribs, the half sections 92 and 94 each include a pair of short oppositely facing outwardly extending guide ribs 96 and 98, respectively, and a diagonally positioned rib 100 forming a spiral configuration. As will be understood, the spiral configuration of the outwardly extending guide ribs of the apparatus 90 functions to remove solid deposits such as paraffin from tubing or a conduit within which the rod having the apparatus 90 attached thereto is reciprocated.

What is claimed is:

1. In a rod guide apparatus formed of a plastic material for a reciprocating rod comprised of two substantially identical half sections which include semicircular recesses therein adapted to be lockingly clamped together adjacent opposite sides of the outer periphery of the rod whereby the rod extends through a circular bore formed by the semicircular recesses in the half sections, the improvement comprising each of said half sections including three longitudinally extending ridges on said surface of said semicircular recess thereof, one of said ridges being positioned at the center of said surface when said recess is viewed laterally and the other two ridges being positioned one on either side of said center ridge at equal distances therefrom whereby when said half sections are clamped together adjacent opposite sides of said rod, the three ridges of each half section contact opposite sides of said rod over arcs of about 60 degrees to 70 degrees and said bore formed by said semicircular recesses through which said rod passes is deformed into an elliptical shape in cross section so that said clamped together half sections contact the periphery of said rod at at least four points, each of said ridges having a height of from about 1/32 inch to about 1/16 inch and a width of from about 1/32 inch to about 3/32 inch.

2. The apparatus of claim 2 wherein each of said half sections includes longitudinal tongue and groove means for telescopic engagement with each other and for clamping said half sections together adjacent opposite sides of said rod and locking means for preventing disengagement of said tongue and groove means.

3. The apparatus of claim 3 wherein said tongue and groove means are comprised of a pair of outwardly extending longitudinal flanges disposed at one end portion of each of said half sections and a pair of longitudinal opposing grooves at the other end portion of each of said half sections.

4. The apparatus of claim 3 wherein said locking means are comprised of a pair of oppositely facing transverse grooves disposed at one end of each of said half sections and a pair of oppositely facing complementary transverse protrusions disposed at the other end of said half sections.

5. The apparatus of claim 4 wherein said flanges and grooves are provided with complementary tapered surfaces to provide a wedging action when two of said half sections are clamped together.

* * * * *